US006700781B2

(12) United States Patent
Chia-Kuan et al.

(10) Patent No.: US 6,700,781 B2
(45) Date of Patent: Mar. 2, 2004

(54) HEAT-DISSIPATING MODULE FOR REMOVING HEAT GENERATED FROM HEAT-GENERATING DEVICE

(75) Inventors: Liao Chia-Kuan, Taoyuan (TW); Hu Sheng-Yan, Taoyuan (TW)

(73) Assignee: Delta Electronics, Inc., Taoyuan Shien (TW)

( * ) Notice: Subject to any disclaimer, the term of this patent is extended or adjusted under 35 U.S.C. 154(b) by 8 days.

(21) Appl. No.: 10/068,089

(22) Filed: Feb. 5, 2002

(65) Prior Publication Data

US 2003/0049142 A1 Mar. 13, 2003

(30) Foreign Application Priority Data

Sep. 12, 2001 (TW) ..... 90122664 A

(51) Int. Cl.[7] ..... H05K 7/20

(52) U.S. Cl. ..... 361/697; 165/121; 310/156.37; 415/178

(58) Field of Search ..... 257/722; 310/156.37, 310/156.32, 86, DIG. 6; 415/177, 178, 213.1, 214.1; 312/236; 454/184; 165/80.3, 185, 121–126; 361/687, 695, 697, 703–705, 709–712, 717–719

(56) References Cited

U.S. PATENT DOCUMENTS

| | | | | |
|---|---|---|---|---|
| 4,007,390 A | * | 2/1977 | Muller et al. | 310/90 |
| 4,891,537 A | * | 1/1990 | Shiraki et al. | 310/68 B |
| 5,995,367 A | * | 11/1999 | Smith et al. | 361/695 |
| RE37,261 E | * | 7/2001 | Schmider et al. | 417/423.7 |
| 6,439,299 B1 | * | 8/2002 | Miyahara et al. | 165/121 |

* cited by examiner

*Primary Examiner*—Gerald Tolin
(74) *Attorney, Agent, or Firm*—Haverstock & Owens LLP

(57) ABSTRACT

A heat-dissipating module includes a lower housing, a first magnet portion, a second magnet portion and a circuit board. The lower housing is made of a highly thermal conductive material. The upper housing has an opening in the center thereof, wherein when the upper housing and the lower housing are jointed together, an outlet is defined. The first magnet portion includes a plurality of first magnets. The second magnet portion has a plurality of second magnets, wherein a permanent magnetic field is formed between the plurality of first magnets and the plurality of second magnets. The circuit board is disposed between the first magnet portion and the second magnet portion and having a plurality of winding coils, wherein when a current is applied to the plurality of winding coils, the permanent magnetic field is repulsed to rotate the blade portion, and an ambient air flow is inhaled from the opening and exhaled via the outlet.

15 Claims, 7 Drawing Sheets

HEAT-DISSIPATING MODULE FOR REMOVING HEAT GENERATED FROM HEAT-GENERATING DEVICE

FIELD OF THE INVENTION

The present invention relates to a heat-dissipating module, and more particularly to a heat-dissipating module for removing heat generated from a heat-generating device.

BACKGROUND OF THE INVENTION

Typically, electronic components are mounted onto a printed circuit board in accordance with a surface mounting technology (SMT). For example, such electronic components include capacitors, resistors, inductors, transformers, diodes, MOSFETs, bare dice and integrated chips. When operating, such electronic components generate energy in the form of heat. If the generated heat could not be effectively removed to the ambient air, the elevated operating temperature might result in a failure of the electronic component or the breakdown of the whole system.

The customarily used heat-dissipating mechanism are divided into the types: an active-type heat-dissipating mechanism and a passive-type heat-dissipating mechanism.

FIG. 1(*a*) is an exploded view showing a commonly active-type heat-dissipating mechanism, which is employed for removing heat generated from a central processing unit (CPU) 11. Such active-type heat-dissipating mechanism includes a heat sink 12 and a fan 13. The heat sink 12 is made of a highly thermal conductive material, for example aluminum, copper, aluminum alloy and copper alloy. The heat sink 12 includes a base 121 and a plurality of sheet-shaped fins 122. The base 121 is attached on and spreads over the top surface of the CPU 11, and the fan 13 is disposed on the heat sink 12. The fan 13 is usually coupled with the heat sink 12 by the engagement of screws 16 with fins 122. By means of the fans 13, the ambient air is inhaled to be in contact with the fins 122 so as to remove most generated heat. Such active-type heat-dissipating mechanism could dissipate heat effectively. However, due to hindrance of the fan hub 131, the inhaled air could not sufficiently remove heat at the position under the hub 131. Therefore, partially generated heat accumulates locally at such position and might result in a failure of the CPU 11 for a long-term period.

Referring to FIG. 1(*b*), the typical passive-type heat-dissipating mechanism is implemented by a blower 23 separated from a heat source 21. The housing of the blower 23 is made of plastic materials, and a blade portion 232 is disposed in the center thereof. When the blower 23 is turned on, the blade portion 232 is rotated to inhale ambient air, which is heated by the heat source 21, into the blower 23 via an inlet 231, and then exhaled via an outlet 233. Such passive-type mechanism can facilitate guiding the air flow and avoid the local accumulation of heat. However, because no heat sink is used, the blower 23 could not remove heat effectively. Therefore, for example in a computer, several blowers 23 are needed, which occupies much space.

SUMMARY OF THE INVENTION

It is an object of the present invention to provide a heat-dissipating module having both the functions of active-type and passive-type heat-dissipating mechanisms.

It is another object of the present invention to provide a heat-dissipating module for removing heat generated from electronic components in operation by both heat conduction and heat convection.

It is another object of the present invention to provide a heat-dissipating module for enhancing heat-dissipating efficiency.

In accordance with an aspect of the present invention, there is provided a heat-dissipating module for removing heat generated from a heat-generating device. The heat-dissipating module includes a lower housing, a first magnet portion, a second magnet portion and a circuit board. The lower housing is made of a highly thermal conductive material. The upper housing has an opening in the center thereof, wherein when the upper housing and the lower housing are jointed together, an outlet is defined. The first magnet portion includes a plurality of first magnets. The second magnet portion has a plurality of second magnets, wherein a permanent magnetic field is formed between the plurality of first magnets and the plurality of second magnets. The circuit board is disposed between the first magnet portion and the second magnet portion and having a plurality of winding coils, wherein when a current is applied to the plurality of winding coils, the permanent magnetic field is repulsed to rotate the blade portion, and an ambient air flow is inhaled from the opening and exhaled via the outlet.

In an embodiment, the heat-generating device is a CPU (central processing unit) in operation. The heat-generating device is attached on a first surface of the lower housing. Preferably, a plurality of pin-shaped fins are disposed on a second surface of the lower housing.

In an embodiment, the highly thermal conductive material is one selected form a group consisting of aluminum, copper, aluminum alloy and copper alloy.

In an embodiment, the blade portion includes a frame and a plurality of blades, the frame being ring-shaped and the plurality of blades being coupled to a bottom surface of the frame. An inner edge of the frame has a protrusion coupled to the second magnet portion. The second magnet portion includes a support, a shaft and at least one rib, a free end of the shaft being inserted into a sleeve of the lower housing, and the at least one rib being interconnected with the other end of the shaft and the support. Preferably, the number of the at least one rib is three, and the ribs are sheet-shaped and symmetrical about the shaft.

Preferably, each of the plurality of winding coils is a conducting line patterned on the circuit board for a plurality of turns.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a schematic diagram showing a passive-type heat-dissipating mechanism in the prior art;

DETAILED DESCRIPTION OF THE PREFERRED EMBODIMENT

Figure 1A:
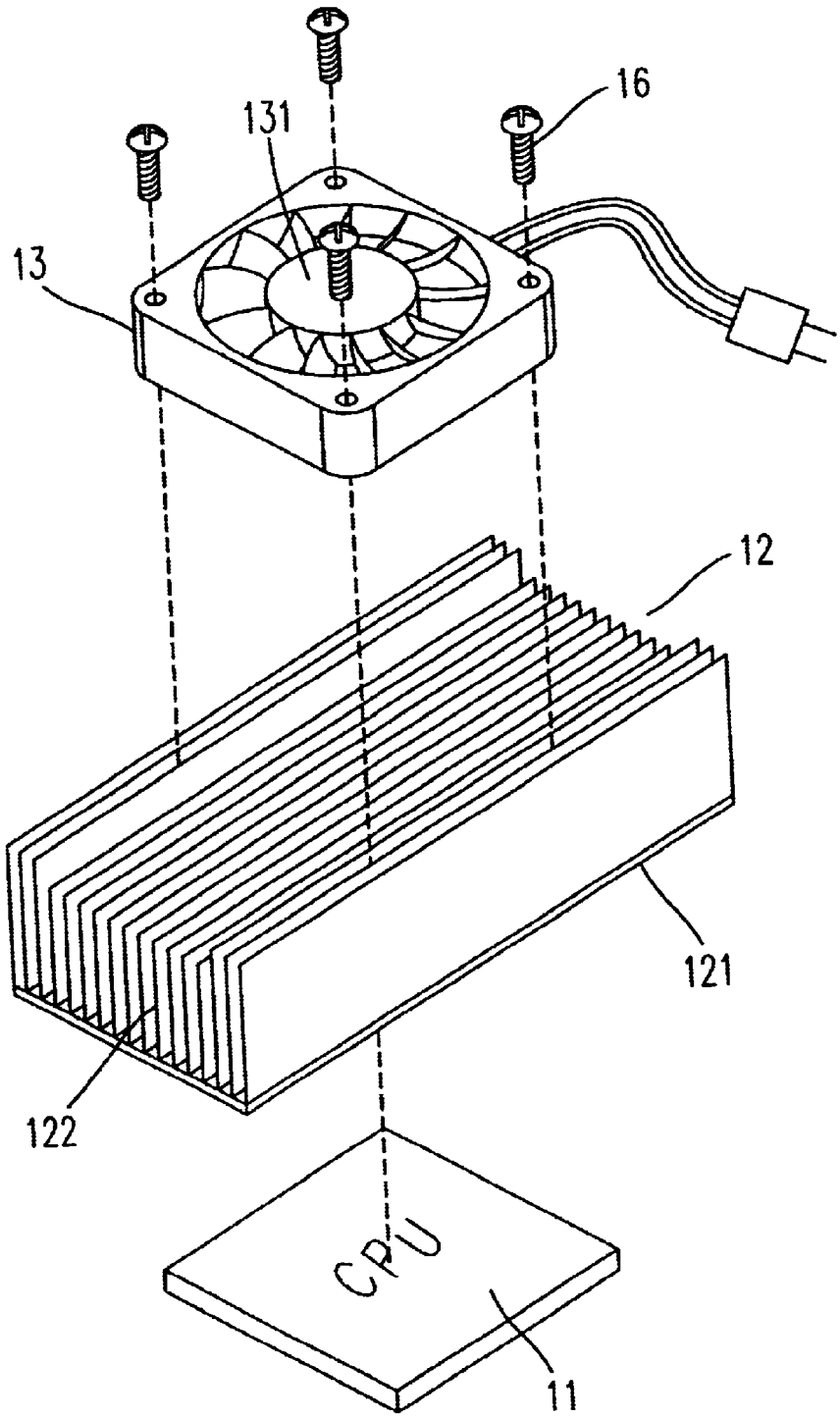
Fig. 1(a) (PRIOR ART)
FIG. 1(*a*) is an exploded view showing an active-type heat-dissipating mechanism in the prior art.
Figure 1B:
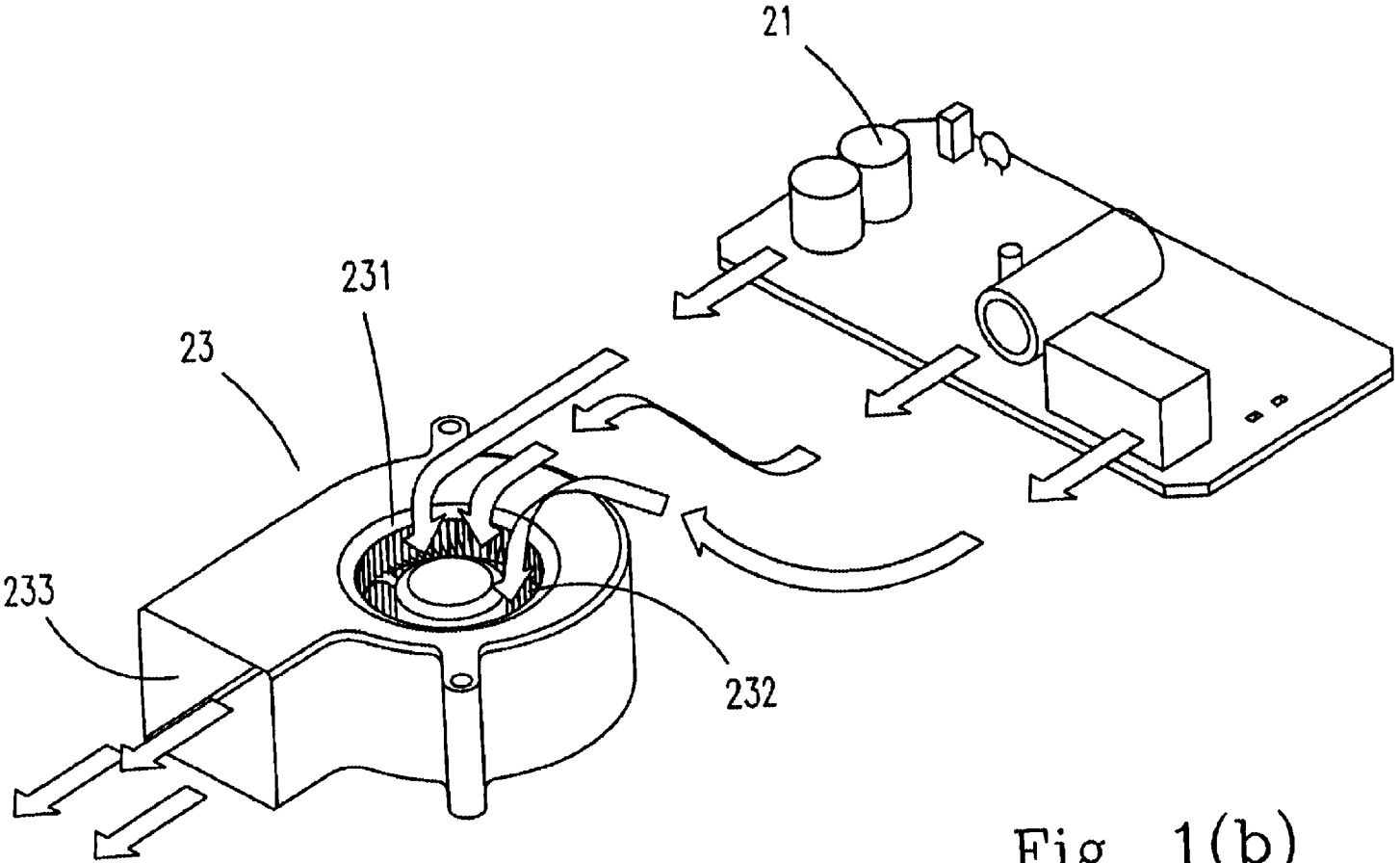
Fig. 1(b) (PRIOR ART)
Figure 2:
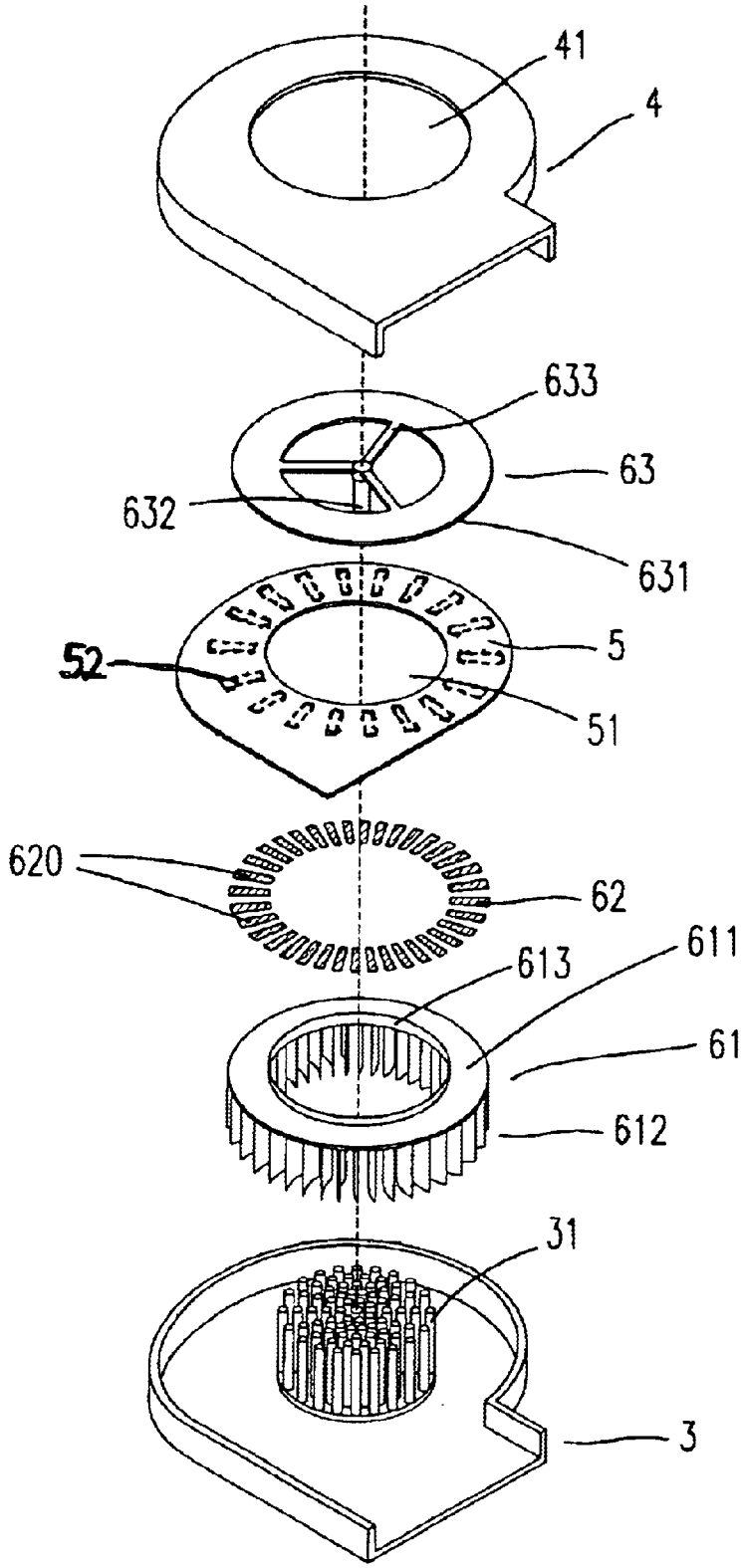
FIG. 2 is an exploded view showing the heat-dissipating module according to a preferred embodiment of the present invention.
Figure 3A:
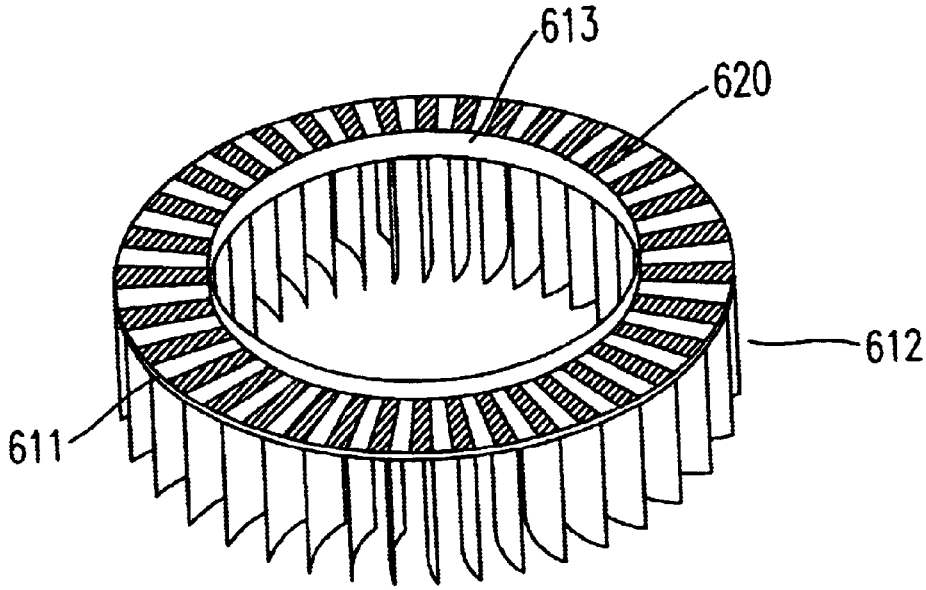
FIGS. 3(*a*) to 3(*d*) are views illustrating the steps for assembling the heat-dissipating module according to a preferred embodiment of the present invention.
Figure 3B:
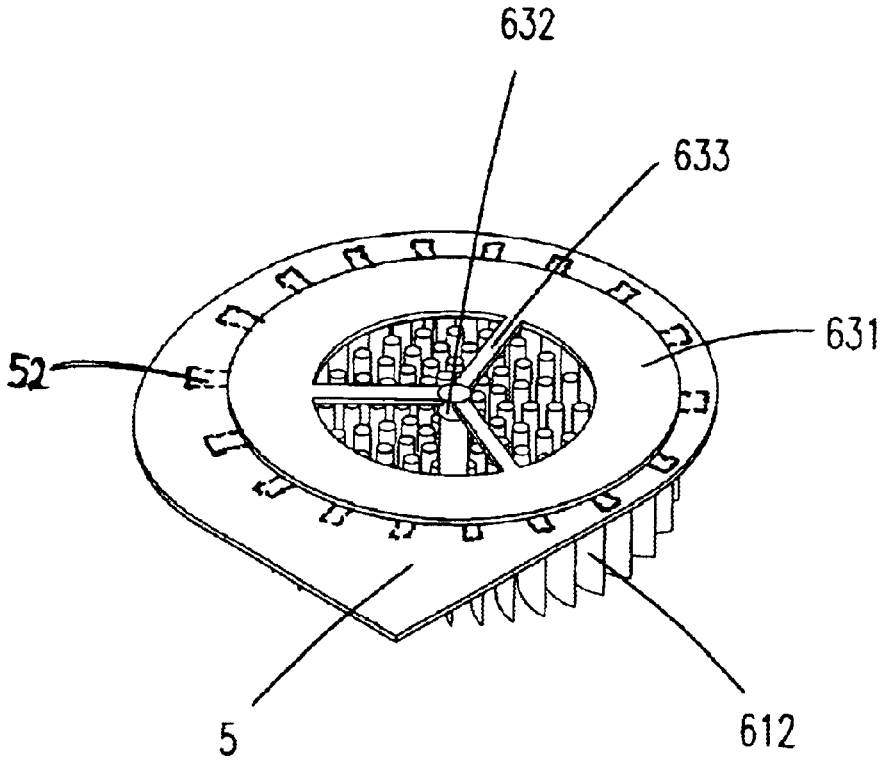
Figure 3C:
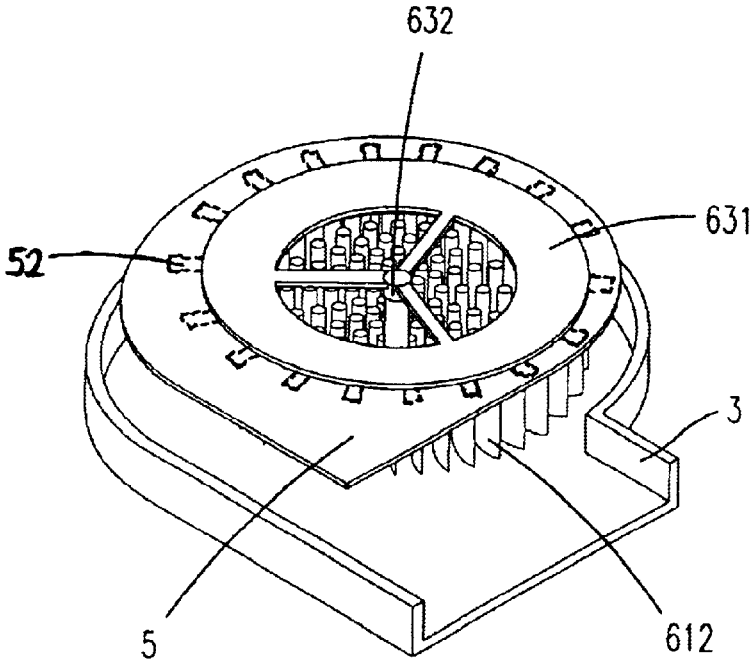
Figure 3D:
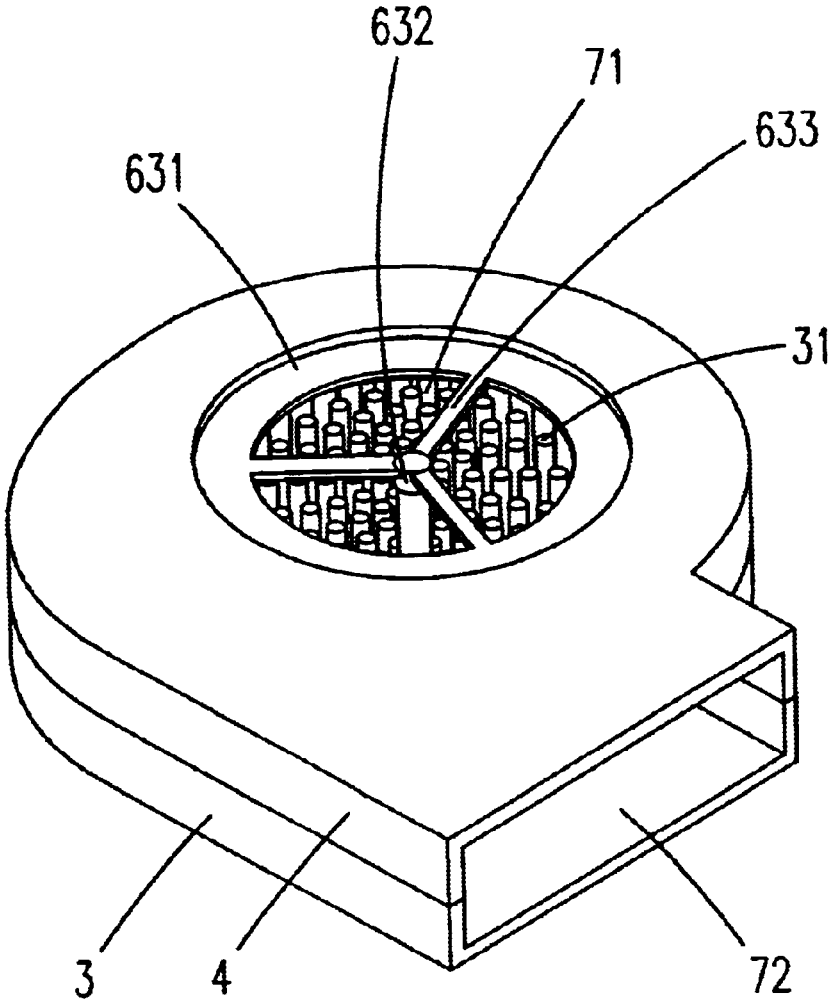

Please refer to FIG. 2. The heat-dissipating module of the present invention includes a lower housing 3, an upper housing 4, a circuit board 5 and a fan, wherein the fan includes a blade portion 61, a first magnet portion 62 and a second magnet portion 63.

The lower housing 3 is made of a highly conductive material, for example aluminum, copper, aluminum alloy and copper alloy. The lower housing 3 has a plurality of fins 31 on the top surface thereof. A CPU chip (not shown) will be attached on the bottom surface of the lower housing 3 by using an anchor belt or by gluing, and thus the heat generated from the CPU chip will be transferred to the fins 31 by means of heat conduction. It is of course that the fins 31 can be in any shape such as sheet-shaped or pin-shaped.

The fan blade portion 61 includes a frame 611 and a plurality of blades 612. The frame 612 is ring-shaped, wherein the inner edge thereof has a protrusion 613, and the plurality of blades 612 are disposed on the bottom surface thereof. The first magnet portion 62 includes a plurality of first magnets 620. The second magnet portion 63 includes a support 631, a shaft 632 and at least one rib 633. The free end of the shaft 632 will be inserted into a sleeve (not shown) on the top surface of the lower housing 3, while the ribs 633 are interconnected with the other end of the shaft 631 and the support 631. The number of the ribs 633 is preferably three, and such ribs 633 are sheet-shaped and symmetrical about the shaft 632, such that the fan can rotate smoothly. There are intervals between ribs 633 for air flow therethrough. Depending on the first magnets 620, the support 631 of the second magnet portion 63 has a plurality of second magnets (not shown) attached on the bottom surface thereof, thereby forming a permanent magnetic field between the first magnets 620 and the second magnets.

The circuit board 5 is equipped with electronic components and winding coils 52 required for controlling and running the fan. The winding coils 52 are employed as a stator part. When an electrical current is applied to the winding coils 52, an electric magnetic field is created to repulse the permanent magnetic field caused from the rotor part, i.e. the combination of the first magnet portion 62 and the second magnet portion 63, thereby driving the blade portion 63 to rotate. In addition, for a purpose of reducing the volume occupied, each winding coil might be a conducting line patterned on the circuit board 5 for a plurality of turns. The operation and principle of the stator part and the rotor part are well known in the art and need not be further described in details herein.

The shape of the upper housing 4 is similar to that of the lower housing 3; however, the upper housing 4 has an opening 41 in the center thereof. The upper housing 4 can be made of any appropriate material, for example either a highly thermal conductive material or a heat-resistant material such as plastic resin.

The steps for assembling the heat-dissipating module of the present invention will be illustrated hereinafter. In FIG. 3(*a*), the plurality of first magnets 620 are attached on the top surface of the fan frame 611. In FIG. 3(*b*), the protrusion 613 of the blade portion 61 penetrates through an opening 51 in the center of the circuit board 51 to be coupled with a bottom surface of the support 631 of the second magnet portion 63. In such way, the fan is substantially finished. In FIG. 3(*c*), The free end of the shaft 632 is inserted into a sleeve (not shown) on a top surface of the lower housing 3. Subsequently, the circuit board 5 should be positioned in order to avoid sliding when the fan is rotated. For example, the top surface of the lower housing 3 and the bottom surface of the upper housing 4 can be respectively equipped with the corresponding engaging elements (not shown), such that the circuit board 5 is fixed when the upper housing 4 and the lower housing 3 are jointed together. In FIG. 3(*d*), when the upper housing 4 and the lower housing 3 are jointed together, an inlet 71 and an outlet are simultaneously formed and defined.

The heat transfer procedures for the heat-dissipating module according to the present invention will be illustrated thereinafter. Since the bottom surface of the lower housing is attached on a CPU chip, the generated heat in operation will be transferred via the lower housing 3 to the fins 31 by heal conduction. Since the winding coils 52 installed on the circuit board 5 are employed as a stator part, the permanent magnetic field formed between the first magnet portion 62 and the second magnet portion 63 will be repulsed so as to drive the blade portion 61 to rotate, when a current is applied to the winding coils 52. Thus, the ambient air is forced to be inhaled via the inlet 71 and in contact with the fins 31 (the fins 31 are disposed substantially under the inlet 71 in this embodiment), and the heated, air flow is guided to be exhaled via the outlet 72.

As will be apparent from the above description according to the present invention, the heat-dissipating module has the following advantages over the prior art:

1. The problem of the local heat accumulation under the fan hub 131, which is occurred in the active-type heat-dissipating mechanism, could be avoided because the lower housing 3 in combination with the fins 31 could be regarded as a heat sink and the inhaled air contacts the fins 31 fully.

2. In the active-type heat-dissipating mechanism, the efficiency for removing heat is still required to be improved because the inhaled air is not well-guided. However, in the present invention, the inhaled air flow is enclosed within the space between the lower housing 3 and the upper housing 4, and then guided by means of a channel defined between the housing and the blade portion 61. Therefore, the heat-dissipating efficiency is also increased.

3. In the typical passive-type heat-dissipating mechanism, the blower 23 is distant from the heat source 21. The passive-type heat-dissipating mechanism has poor heat-dissipating efficiency due to heat convection. However, the heat-dissipating module of the present invention removes heat by both heat conduction and heat convection to enhance heat dissipation.

4. If the generated heat from a CPU chip 11 and lower power electronic components 21 are needed to be removed, both the active-type and the passive-type heat-dissipating mechanism are required in the prior art. However, only a heat-dissipating module is needed in the present invention, for example the heated air flow from the low power electronic components 21 is inhaled via the inlet 71. Therefore, the present heat-dissipating module has potential for being a standard type of heat-dissipating apparatus.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A heat-dissipating module for removing heat generated from a heat-generating device, comprising:

a lower housing made of a highly thermal conductive material;

an upper housing having an opening in the center thereof, wherein when said upper housing and said lower housing are jointed together, an outlet is defined;

a blade portion;

a first magnet portion including a plurality of first magnets;

a second magnet portion having a plurality of second magnets, a support, a shaft and at least one rib, wherein a permanent magnetic field is formed between said plurality of first magnets and said plurality of second magnets, a free end of said shaft being inserted into a sleeve of said lower housing, and said at least one rib being interconnected with the other end of said shaft and said support; and a circuit board between said first magnet portion and said second magnet portion and having a plurality of winding coils, wherein when a current is applied to said plurality of winding coils, said permanent magnetic field is repulsed to rotate said blade portion, and an ambient air flow is inhaled from said opening and exhaled via said outlet.

2. The heat-dissipating module according to claim 1, wherein a plurality of fins are disposed on a second surface of said lower housing.

3. The heat-dissipating module according to claim 2, wherein said fins are pin-shaped.

4. The heat-dissipating module according to claim 1, wherein said highly thermal conductive material is one selected from a group consisting of aluminum, copper, aluminum alloy and copper alloy.

5. The heat-dissipating module according to claim 1, wherein said blade portion comprises a frame and a plurality of blades, said frame being ring-shaped and said plurality of blades being coupled to a bottom surface of said frame.

6. The heat-dissipating module according to claim 5, wherein an inner edge of said frame has a protrusion coupled to said second magnet portion.

7. The heat-dissipating module according to claim 1, wherein the number of said at least one rib is three.

8. The heat-dissipating module according to claim 7, said at least one rib is sheet-shaped and symmetrical about said shaft.

9. The heat-dissipating module according to claim 1, wherein each of said plurality of winding coils is a conducting line patterned on the circuit board for a plurality of turns.

10. A heat-dissipating module for removing heat generated from a heat-generating device, comprising:

a lower housing made of a highly thermal conductive material, and having a first surface in contact with said heat-generating device and a plurality of fins extending from a second surface thereof;

an upper housing having an opening in the center thereof, wherein when said upper housing and said lower housing are jointed together, an outlet is defined;

a blade portion;

a first magnet portion including a plurality of first magnets;

a second magnet portion having a plurality of second magnets, a support, a shaft and at least one rib, wherein a permanent magnetic field is formed between said plurality of first magnets and said plurality of second magnets, a free end of said shaft being inserted into a sleeve of said lower housing, and said at least one rib being interconnected with the other end of said shaft and said support; and a circuit board between said first magnet portion and said second magnet portion and having a plurality of winding coils, wherein when a current is applied to said plurality of winding coils, said permanent magnetic field is repulsed to rotate said blade portion, and an ambient air flow is inhaled from said opening and exhaled via said outlet.

11. The heat-dissipating module according to claim 10, wherein said fins are pin-shaped.

12. The heat-dissipating module according to claim 10, wherein said highly thermal conductive material is one selected from a group consisting of aluminum, copper, aluminum alloy and copper alloy.

13. The heat-dissipating module according to claim 10, wherein said blade portion comprises a frame and a plurality of blades, said frame being ring-shaped and said plurality of blades being coupled to a bottom surface of said frame.

14. The heat-dissipating module according to claim 13, wherein an inner edge of said frame has a protrusion coupled to said second magnet portion.

15. The heat-dissipating module according to claim 10, wherein each of said plurality of winding coils is a conducting line patterned on the circuit board for a plurality of turns.

* * * * *